US007812239B2

(12) United States Patent
Fujishima et al.

(10) Patent No.: US 7,812,239 B2
(45) Date of Patent: Oct. 12, 2010

(54) MUSIC PIECE PROCESSING APPARATUS AND METHOD

(75) Inventors: Takuya Fujishima, Hamamatsu (JP); Maarten De Boer, Barcelona (ES); Jordi Bonada, Barcelona (ES); Samuel Roig, Barcelona (ES); Fokke De Jong, Amsterdam (NL); Sebastian Streich, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/218,396

(22) Filed: Jul. 15, 2008

(65) Prior Publication Data

US 2009/0019996 A1 Jan. 22, 2009

(30) Foreign Application Priority Data

Jul. 17, 2007 (JP) ..... 2007-186149

(51) Int. Cl.
*G10H 1/00* (2006.01)

(52) U.S. Cl. ..... 84/600; 700/94

(58) Field of Classification Search ..... 84/600–602; 700/94

See application file for complete search history.

(56) References Cited

U.S. PATENT DOCUMENTS 6,539,395 B1 * 3/2003 Gjerdingen et al. ..... 707/102
7,031,980 B2 * 4/2006 Logan et al. ..... 707/104.1
7,282,632 B2 * 10/2007 van Pinxteren et al. ..... 84/616
7,304,231 B2 * 12/2007 van Pinxteren et al. ..... 84/615
7,340,455 B2 * 3/2008 Platt et al. ..... 707/3
7,345,233 B2 * 3/2008 van Pinxteren et al. ..... 84/615
7,571,183 B2 * 8/2009 Renshaw et al. ..... 707/102
2002/0088336 A1 * 7/2002 Stahl ..... 84/609
2002/0181711 A1 * 12/2002 Logan et al. ..... 381/1

(Continued)

FOREIGN PATENT DOCUMENTS

JP 2003108132 4/2003

(Continued)

OTHER PUBLICATIONS

Extended European Search Report of European Patent Application No. 08160376.3 of Yamaha Corporation, dated May 7, 2010, 5 pages.

(Continued)

*Primary Examiner*—David S. Warren
(74) *Attorney, Agent, or Firm*—Pillsbury Winthrop Shaw Pittman LLP

(57) ABSTRACT

Storage section has stored therein music piece data sets of a plurality of music pieces, each of the music piece data sets including respective tone data of a plurality of fragments of the music piece and respective character values indicative of musical characters of the fragments. Each of the fragments of a selected main music piece is selected as a main fragment, and each one, other than the selected main fragment, of a plurality of fragments of two or more music pieces is selected as a sub fragment. A similarity index value indicative of a degree of similarity between the character value of the main fragment and the character value of the specified sub fragment is calculated. For each of the main fragments, a sub fragment presenting a similarity index value that satisfies a predetermined selection condition is selected for processing the tone data of the main music piece.

20 Claims, 5 Drawing Sheets

U.S. PATENT DOCUMENTS

| | | | | |
|---|---|---|---|---|
| 2003/0065517 | A1 | 4/2003 | Miyashita et al. | |
| 2003/0205124 | A1* | 11/2003 | Foote et al. | 84/608 |
| 2004/0163527 | A1* | 8/2004 | Kawai et al. | 84/603 |
| 2006/0065106 | A1* | 3/2006 | Pinxteren et al. | 84/615 |
| 2006/0074649 | A1 | 4/2006 | Pachet et al. | |
| 2006/0080095 | A1* | 4/2006 | Pinxteren et al. | 704/233 |
| 2006/0080100 | A1* | 4/2006 | Pinxteren et al. | 704/249 |
| 2006/0107823 | A1* | 5/2006 | Platt et al. | 84/616 |
| 2006/0112082 | A1* | 5/2006 | Platt et al. | 707/3 |
| 2006/0112098 | A1* | 5/2006 | Renshaw et al. | 707/7 |
| 2007/0157797 | A1* | 7/2007 | Hashizume et al. | 84/609 |
| 2007/0169613 | A1* | 7/2007 | Kim et al. | 84/609 |
| 2007/0174274 | A1* | 7/2007 | Kim et al. | 707/5 |
| 2007/0208990 | A1* | 9/2007 | Kim et al. | 715/500.1 |
| 2007/0239654 | A1* | 10/2007 | Kraft et al. | 707/1 |
| 2008/0052371 | A1* | 2/2008 | Partovi et al. | 709/217 |
| 2008/0075303 | A1* | 3/2008 | Kim et al. | 381/103 |
| 2008/0115658 | A1* | 5/2008 | Fujishima et al. | 84/618 |
| 2008/0132187 | A1* | 6/2008 | Hanebeck | 455/186.1 |
| 2008/0147215 | A1* | 6/2008 | Kim et al. | 700/94 |
| 2008/0168074 | A1* | 7/2008 | Inagaki | 707/100 |
| 2008/0222128 | A1* | 9/2008 | Yoshida et al. | 707/5 |
| 2008/0236371 | A1* | 10/2008 | Eronen | 84/622 |
| 2008/0288255 | A1* | 11/2008 | Carin et al. | 704/256.1 |
| 2009/0019996 | A1* | 1/2009 | Fujishima et al. | 84/625 |
| 2009/0043758 | A1* | 2/2009 | Kobayashi et al. | 707/5 |
| 2009/0043811 | A1* | 2/2009 | Yamamoto et al. | 707/104.1 |
| 2009/0095145 | A1* | 4/2009 | Streich et al. | 84/609 |
| 2009/0150445 | A1* | 6/2009 | Herberger et al. | 707/104.1 |
| 2009/0173214 | A1* | 7/2009 | Eom et al. | 84/610 |
| 2009/0217804 | A1* | 9/2009 | Lu et al. | 84/602 |

FOREIGN PATENT DOCUMENTS

| | | |
|---|---|---|
| JP | 2006106754 | 4/2006 |
| WO | WO 2006/079813 A1 | 8/2006 |

OTHER PUBLICATIONS

"Audio System for Portable Market" by Fitzgerald J. Archibald, published in the Audio Engineering Society, Convention Paper 6906, presented at the 121st Convention on Oct. 5-8, 2006 in San Francisco, CA USA, 14 pages.

* cited by examiner

MUSIC PIECE PROCESSING APPARATUS AND METHOD

BACKGROUND

The present invention relates to techniques for processing music pieces.

Disk jockeys (DJs), for example, reproduce a plurality of music pieces one after another while interconnecting the music pieces with no break therebetween. Japanese Patent Application Laid-open Publication No. 2003-108,132 discloses a technique for realizing such music piece reproduction. The technique disclosed in the No. 2003-108,132 publication allows a plurality of music pieces to be interconnected smoothly by controlling respective reproduction timing of the music pieces in such a manner that beat positions of successive ones of the music pieces agree with each other.

In order to organize a natural and refined music piece from a plurality music pieces, selection of proper music pieces as well as adjustment of reproduction timing of the music pieces becomes an important factor. Namely, even where beat positions of individual music pieces are merely adjusted as with the technique disclosed in the No. 2003-108,132 publication, it would not be possible to organize an auditorily-natural music piece if the music pieces greatly differ from each other in musical characteristic.

SUMMARY OF THE INVENTION

In view of the foregoing, it is an object of the present invention to produce, from a plurality of music pieces, a music piece with no uncomfortable feeling.

In order to accomplish the above-mentioned object, the present invention provides an improved music piece processing apparatus, which comprises: a storage section that stores music piece data sets of a plurality of music pieces, each of the music piece data sets comprising respective tone data of a plurality of fragments of the music piece and respective character values of the fragments, the character value of each of the fragments being indicative of a musical character of the fragment; a similarity index calculation section that selects, as a main fragment, one of plurality of fragments of a main music piece selected from among the plurality of music pieces stored in the storage section; specifies, as a sub fragment, each one, other than the selected main fragment, of a plurality of fragments of two or more music pieces selected from among the plurality of music pieces stored in the storage section; and calculates a similarity index value indicative of a degree of similarity between the character value of the selected main fragment and the character value of the specified sub fragment, the similarity index calculation section selecting, as the main fragment, each of the plurality of fragments of the selected main music piece and calculating the similarity index value for each of the main fragments; a condition setting section that sets a selection condition; a selection section that selects, for each of the main fragments of the main music piece, a sub fragment presenting a similarity index value that satisfies the selection condition; and a processing section that processes the tone data of each of the main fragments of the main music piece on the basis of the tone data of the sub fragment selected by the selection section for the main fragment. Namely, the sub fragment, selected in accordance with the calculated similarity index value with respect to the main fragment, is used for processing of the main fragment, and thus, even where the user is not sufficiently familiar with similarity and harmonizability among the music pieces, the present invention permits production or organization of an auditorily-natural music piece without substantially impairing the melodic sequence of the main music piece.

As an example, the condition setting section sets the selection condition on the basis of user's input operation performed via an input device. Such an arrangement allows the user to process a music piece with an enhanced degree of freedom.

As an example, the condition setting section sets a plurality of the selection conditions, at least one of the plurality of the selection conditions being settable on the basis of user's input operation, and the selection section selects the sub fragment in accordance with a combination of the plurality of the selection conditions. Such an arrangement can significantly enhance a degree of freedom of music piece processing without requiring complicated operation of the user.

In a preferred implementation, each of the fragments is a section obtained by dividing the music piece at time points synchronous with beats. For example, fragments are sections obtained by dividing the music piece at every beat or every predetermined plurality of beats, or by dividing each interval between successive beats into a plurality of segments (e.g., segment of a time length corresponding to ½ or ¼ beat). Because sections obtained by dividing the music piece at time points synchronous with beats are set as the fragments, this inventive arrangement can produce a natural music piece while maintaining a rhythm feeling of the main music piece.

Whereas any desired selection condition may be set by the condition setting section, the following examples may be advantageously employed. As a first example, the condition setting section sets a reference position, in order of the similarity with the main fragment, as the selection condition on the basis of user's input operation, and the selection section selects a sub fragment located at a position corresponding to the reference position in the order of similarity with the main fragment. As a second example, the condition setting section sets a random number range as the selection condition, and the selection section generates a random number within the random number range and selects a sub fragment located at a position corresponding to the random number in the order of similarity with the main fragment. As a third example, the condition setting section sets a total number of selection as the selection condition, and the selection section selects a given number of the sub fragments corresponding to the total number of selection. As a fourth example, the condition setting section sets a maximum number of selection as the selection condition, and the selection section selects, for each of the main fragments, a plurality of the sub fragments while limiting a maximum number of the sub fragments, selectable from one music piece, to the maximum number of selection.

According to a preferred embodiment, the music piece processing apparatus further comprises a mixing section that mixes together the tone data having been processed by the processing section and original tone data of the main music piece and outputs the mixed tone data. Mixing ratio between the tone data having been processed by the processing section and the original tone data of the main music piece is set on the basis of user's input operation performed via the input device. Which one of the tone data having been processed by the processing section and the original tone data of the main music piece should be prioritized over the other can be changed as necessary on the basis of user's input operation performed via the input device. In another preferred implementation, the music piece processing apparatus further comprises a tone length adjustment section that processes each of the tone data, having been processed by the processing section, so that a predetermined portion of the tone data is made a silent portion. Further, the predetermined portion is a portion from a halfway time point to an end point of a tone generating section corresponding to the tone data, and a length of the predetermined portion is set on the basis of user's operation performed via the input device. According to the preferred implementation, it is possible to change as necessary the lengths of individual tones (i.e., rhythm feeling of the music piece) on the basis of user's input operation performed via the input device.

In a preferred embodiment, the music piece processing apparatus further comprises a pitch control section that controls, for each of the two or more music pieces, a pitch of a tone, represented by the tone data of each of the sub fragments selected by the selection section, on the basis of user's operation performed via an input device. Such an arrangement can organize a music piece having a feeling of unity, for example, in tone pitch by adjusting tone pitches per music piece. The music piece processing apparatus further comprises an effect impartment section that imparts an acoustic effect to the tone data of each of the sub fragments selected by the selection section, and, for each of the two or more music pieces, the effect impartment section controls the acoustic effect to be imparted, on the basis of user's operation performed via an input device. Such an arrangement can organize a music piece having a feeling of unity by adjusting the acoustic effect per music piece.

In a preferred embodiment, the similarity index calculation section includes: a similarity determination section that calculates, for each of the main fragments, a basic index value indicative of similarity/dissimilarity in character value between the main fragment and each of the sub fragments; and an adjustment section that determines a similarity index value on the basis of the basic index value calculated by the similarity determination section, wherein, of the basic index values calculated for individual ones of the sub fragments with respect to a given main fragment, the adjustment section adjusts the basic index values of one or more sub fragments, following one or more sub fragments selected by the selection section for the given main fragment, so as to increase a degree of similarity, to thereby determine the similarity index value. Such an arrangement can increase a possibility of sub fragments of the same music piece being selected in succession, and thus, it is possible to organize a music piece while maintaining a melodic sequence of a particular music piece.

In another embodiment, the similarity index calculation section includes: a similarity determination section that calculates, for each of the main fragments, a basic index value indicative of similarity/dissimilarity in character value between the main fragment and each of the sub fragments; a coefficient setting section that sets a coefficient separately for each of the music pieces on the basis of user's input operation performed via an input device; and an adjustment section that calculates the similarity index value by adjusting each of the basic index values, calculated by the similarity determination section, in accordance with the coefficient set by the coefficient setting section. Because the similarity index value is adjusted per music piece in accordance with the coefficient set by the coefficient setting section, a frequency with which sub fragments of each of the music piece are used for processing of the main music piece can increase or decrease in response to an input to the input device. Thus, the inventive arrangement can organize a music piece agreeing with user's intension.

The aforementioned music piece processing apparatus of the present invention may be implemented not only by hardware (electronic circuitry), such as a DSP (Digital Signal Processor) dedicated to various processing of the invention, but also by cooperative operations between a general-purpose processor device, such as a CPU (Central Processing Unit), and software programs. Further, the present invention may be implemented as a computer-readable storage medium containing a program for causing the computer to perform the various steps of the aforementioned music piece processing method. Such a program may be supplied from a server apparatus through delivery over a communication network and then installed into the computer.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

A. First Embodiment

Figure 1:
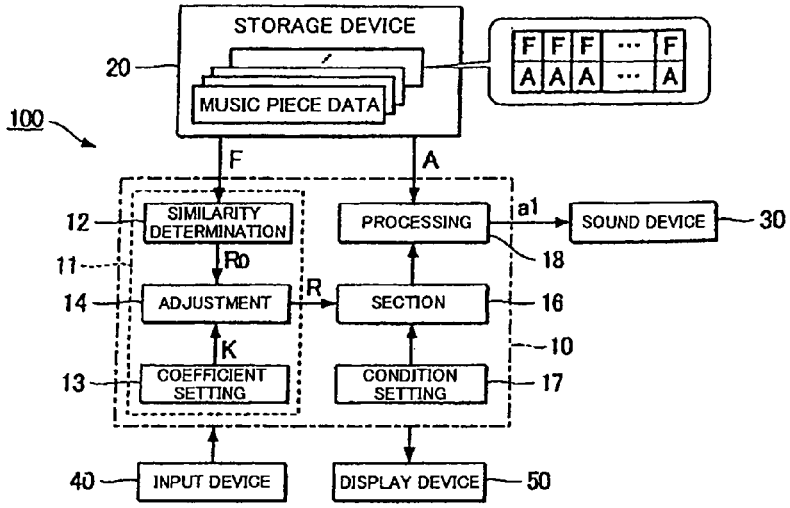
FIG. 1 is a block diagram showing an example general setup of a music piece processing apparatus in accordance with a first embodiment of the present invention.

FIG. 1 is a block diagram showing an example general setup of a music piece processing apparatus in accordance with an embodiment of the present invention. This music piece processing apparatus 100 is an apparatus designed to process a music piece (hereinafter referred to as "main music piece") using a plurality of music pieces, and, as shown in FIG. 1, it is implemented by a computer system (e.g., personal computer) that includes a control device 10, a storage device 20, a sounding device 30, an input device 40 and a display device 50.

The control device 10 is a processing unit (CPU) that controls various components of the music piece processing apparatus 100 by executing software programs. The storage device 20 stores therein the programs to be executed by the control device 10 and various data to be processed by the control device 10. For example, any of a semiconductor storage device, magnetic storage device, etc. can be suitably used as the storage device 20. Further, the storage device 20 stores respective music data sets of a plurality of music pieces, as shown in FIG. 1.

Figure 2:
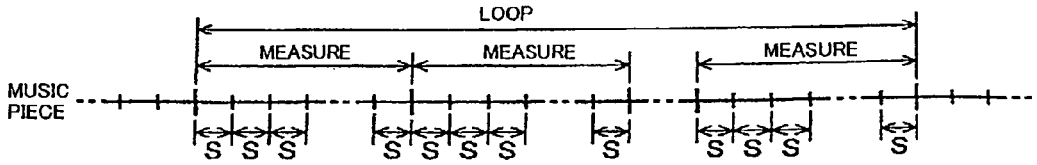
FIG. 2 is a diagram explanatory of fragments of a music piece.

FIG. 2 is conceptual diagram showing an example setup of a music piece. According to the instant embodiment, each music piece is segmented into a multiplicity of measures. As shown in FIG. 2, a section (hereinafter referred to as "loop") comprising a plurality of measures is defined in the music piece. The "loop" is, for example, a characteristic section (e.g., so-called "bridge"), and can be defined by a user operating the input device 40 to designate start and end points of the loop in the music piece. In an alternative, the control device 10 may automatically designate, as such a loop, a given section of the music piece which satisfies a predetermined condition. Note that the entire music piece may be set as a loop.

As further shown in FIG. 2, each measure of the music piece is segmented into a plurality of segments (hereinafter referred to as "fragments" S) each corresponding to one or more beats (i.e., using one or more beats as a segmentation unit); in the illustrated example of FIG. 2, each of the fragments corresponds to one beat. Therefore, in the case of a music piece in duple time, each segment obtained by dividing one measure into two equal segments corresponds to one fragment S, in the case of a music piece in triple time, each segment obtained by dividing one measure into three equal segments corresponds to one fragment S, and so on. Note that the fragment S may alternatively be a segment obtained by dividing one beat into a plurality of segments (e.g., segment corresponding to 1/2 or 1/4 beat).

As shown in FIG. 1, a music piece data set, corresponding to (i.e., representative of) one music piece, includes, for each of a plurality of fragments S belonging to the loop of the music piece, tone data (waveform data) A representative of a sound waveform of each tone belonging to the fragment S, and a numerical value F determining musical characters of the fragment S (hereinafter referred to as "character value F"). In the illustrated example, the character value F is represented by an N-dimensional vector defined by respective values of N (N is a natural number) types of character elements of the tone, such as sound energy (intensity), centroid of a frequency-amplitude spectrum, frequency at which spectral intensity becomes the greatest (i.e., frequency presenting a maximum spectral intensity) and MFCC (Mel-Frequency Cepstrum Coefficient).

The input device 40 is equipment, such as a mouse and keyboard, that includes a plurality of operation members operable by a user to give instructions to the music piece processing apparatus 100. For example, the user designates M (M is an integral number greater than one) music pieces to be processed by the music piece processing apparatus 100 (these music pieces to be processed will hereinafter be referred to as "object music pieces") from among a plurality of music pieces whose music piece data are stored in the storage device 20.

The control device 10 processes respective tone data A of a plurality of fragments S of a main music piece selected from among M object music pieces (the fragments S of the selected main music piece will hereinafter referred to as "main fragments Sm") on the basis of one or more sub fragments Ss, selected from among all of the fragments of the M object music pieces other than the main fragments Sm, whose character values F are similar to those of the main fragments Sm. Then, the control device 10 sequentially output the processed tone data. Selection of the main music piece may be made either on the basis of user's operation performed via the input device 40, or automatically by the control device 10. The sounding device 30 produces an audible tone on the basis of a data train a1 of the tone data A output from the control device 10. For example, the sounding device 30 includes a D/A converter for generating an analog signal from the tone data A, an amplifier for amplifying the signal output from the D/A converter, and sounding equipment, such as a speaker or headphones, that outputs a sound wave corresponding to the signal output from the amplifier.

Figure 3:
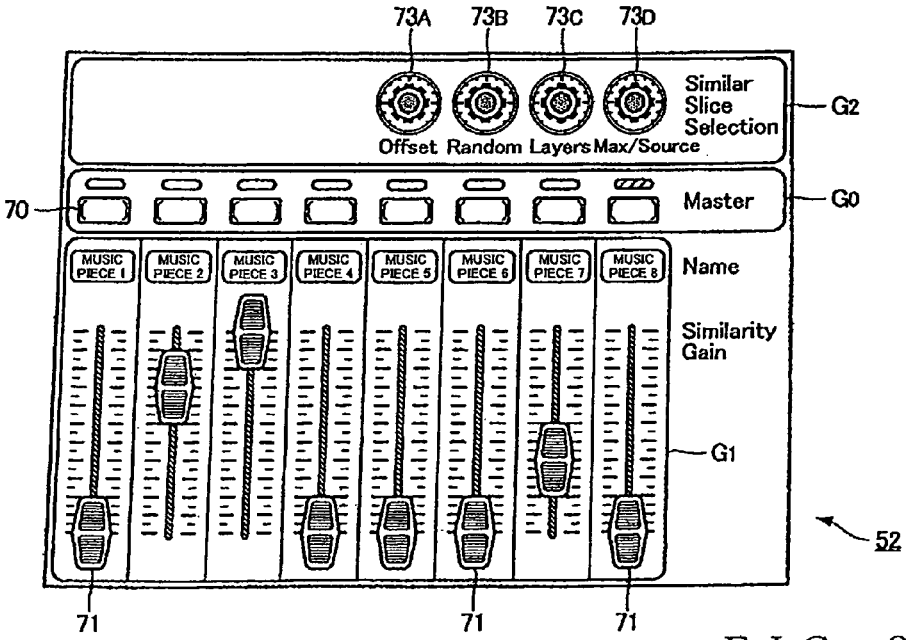
FIG. 3 is a diagram schematically showing an example of an operation screen employed in the first embodiment.

The display device 50 visually displays various images under control of the control device 10. For example, while the music piece processing apparatus is in operation, an operation screen 52 as shown in FIG. 3 is kept displayed on the display device 50. The user can give various instructions to the music piece processing apparatus 100 by designating or activating corresponding portions of the operation screen 52. As shown in FIG. 3, the operation screen 52 includes the names of M object music pieces selected by the user, and an area G0 where are displayed images of M operation members (buttons) 70 corresponding to the M object music pieces. The user can operate the input device 40 to activate any one of the M operation members 70, so that the object music piece corresponding to the activated operation member 70 can be designated as a main music piece (Master).

Next, a description will be given about specific functions of the control device 10. As shown in FIG. 1, the control device 10 functions as a plurality of components, i.e. similarity index calculation section 11, selection section 16, condition setting section 17 and processing section 18, by executing programs stored in the storage device 20. Each of the components of the control device 10 may also be implemented by an electronic circuit, such as a DSP, dedicated to tone processing. Further, the control device 10 may be implemented by a plurality of separate integrated circuits.

For each of a plurality of main fragments Sm of a main music piece, the similarity index calculation section 11 specifies all of the fragments, other than the main fragment Sm, as sub fragments Ss. Then, the similarity index calculation section 11 calculates, for each of the specified sub fragments Ss, a numerical value indicative of a degree of similarity R between the main fragment Sm and the sub fragment S (hereinafter referred to as "similarity index value"). The similarity index calculation section 11 in the instant embodiment includes a similarity determination section 12, a coefficient setting section 13 and an adjustment section 14.

The similarity determination section 12 calculates a value R0 serving as a basis for the similarity index value R (the value R0 will hereinafter be referred to as "basic index value"). Similarly to the similarity index value R, the basic index value R0 is a numerical value that serves as an index between character values F of the main and sub fragments Sm and Ss. More specifically, the similarity determination section 12 sequentially acquires the character values F of the individual main fragments Sm from the storage device 20 and calculates, for each of the sub fragments Ss of the M object music pieces, a basic index value R0 corresponding to the character value F of one of the main fragments Sm and the character value F of the sub fragment Ss. Such a basic index value R0 between the main fragment Sm and the sub fragment Ss is calculated, for example, as an inverse number of an Euclid distance between coordinates specified in an N-dimensional space having N numerical values of the character values F. Therefore, it can be said that the main fragment Sm and the sub fragment Ss are more similar in musical character if the basic index value R0 calculated therebetween is greater.

The coefficient setting section 13 sets a coefficient K separately for each of the M object music pieces. In the instant embodiment, the coefficient setting section 17 controls the coefficient K individually for each of the object music pieces in response to user's operation performed on an area G1 of the operation screen 52 of FIG. 3. The area G1 includes images of M operation members (sliders) 71 corresponding to the M object music pieces. The user can vertically move any desired one of the operation members 71 by operating the input device 40. For each of the M object music pieces, the coefficient setting section 13 sets a coefficient K corresponding to a current operating position of the operation member 71 corresponding to the object music piece in question. In the instant embodiment, the coefficient K is set at zero when the corresponding operation member 71 is at the lower end of its movable range, and the coefficient K gradually increases in value as the operation member 71 is moved toward the upper end of its movable range.

For each of the object music pieces, the adjustment section 16 adjusts the basic index value R0, calculated by the similarity determination section 12, in accordance with the coefficient K. More specifically, the adjustment section 16 calculates, as the similarity index value R, a product (i.e., result of multiplication) between the basic index value R0 calculated per sub fragment Ss of any one of the object music pieces and the coefficient K set by the coefficient setting section 13 for that object music piece.

The selection section 16 selects, for each of the plurality of main fragments Sm of the main music piece, a predetermined number of, i.e., one or more, sub fragments Ss whose similarity index value R calculated with respect to the main fragments Sm indicates relatively close similarity. The condition setting section 17 sets a condition of selection by the selection section 16, in accordance with an input to the input device 40. The processing section 18 replaces the tone data A of some of the main fragments Sm of the main music piece with the tone data A of the predetermined number of sub fragments Ss selected by the selection section 16 for the main fragments Sm and then sequentially outputs the replaced tone data A.

Area G2 of the operation screen 52 shown in FIG. 3 is an area for the user to input one or more desired selection conditions to the music piece processing apparatus 100. The area G2 contains images of a plurality of operation members (knobs) 73 (73A, 73B, 73C and 73D). The user can rotate any desired one of the operation members 73 independently of the other operation members (knobs) 73 by operating the input device 40. For example, the condition setting section 17 sets a reference position $C_A$ in accordance with an operating angle of the operation member 73A (Offset) and sets a random number range $C_B$ in accordance with an operating angle of the operation member 73B (Random). The selection section 16 generates a random number r within the random number range $C_B$. The condition setting section 17 also sets a total number of selection $C_C$ in accordance with an operating angle of the operation member 73C (Layers) and sets a maximum number of selection $C_D$ in accordance with an operating angle of the operation member 73D (Max/Source). The selection section 16 selects, from among the plurality of sub fragments Ss, a sub fragment Ss whose similarity index value R calculated with respect to the main fragment Sm satisfies a selection condition.

Figure 4:
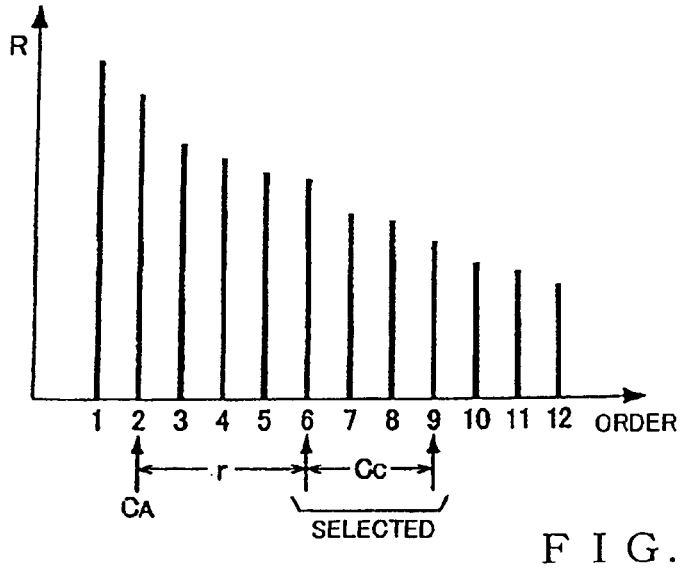
FIG. 4 is a conceptual diagram explanatory of a selection condition employed in the first embodiment.

FIG. 4 is a conceptual diagram showing relationship between a similarity index value R calculated per sub fragment Ss and a selection condition for use by the selection section 16. In FIG. 4, the vertical axis represents the similarity index value R calculated per sub fragment Ss with respect to one main fragment Sm, while the horizontal axis represents respective positions of a plurality of sub fragments are arranged in order of similarity with the main fragment Sm (namely, in descending order of the similarity index value R, which will be referred to as "similarity order"). As shown in FIG. 4, the selection section 16 selects a predetermined number of sub fragments Ss, corresponding to the total number of selection $C_C$, with one of the sub fragments Ss, which is lower than the reference position $C_A$ in the similarity order by a specific number of positions corresponding to the random number r, designated as the leading-end or first sub fragment Ss of the selected predetermined number of sub fragments Ss. In FIG. 4, there is shown an example where four sub fragments Ss corresponding to the total number of selection $C_C$ ($C_C$=4) of selections are selected with the sixth-position sub fragment Ss, lower than the reference position $C_A$ (in this case, second position, i.e. $C_A$=2) by four positions (r=4), designated as the leading-end sub fragment Ss of the selected predetermined number of sub fragments Ss. Namely, in the instant embodiment, there are a plurality of selection conditions $C_A$, r, $C_C$, . . . , and the user designates at least one of the selection conditions ($C_A$).

As seen from above, as the reference position $C_A$ designated by the user increases in value, a sub fragment Ss having a lower degree of similarity with the main fragment Sm is selected. Further, as the random number range $C_B$ increases, the range of sub fragments Ss selectable by the selection section 16 increases. Furthermore, as the total number of selection $C_C$ increases, the number of sub fragments Ss selectable by the selection section 16 increases. Note, however, that the selection section 16 limits the maximum number of sub fragments Ss selectable from one music piece to the maximum number of selection $C_D$. Thus, as the maximum number of selection $C_D$ increases, the number of sub fragments Ss to be selected from one music piece increases; namely, as the maximum number of selection $C_D$ decreases, sub fragments Ss are selected dispersively from a greater number of object music pieces.

Figure 5:
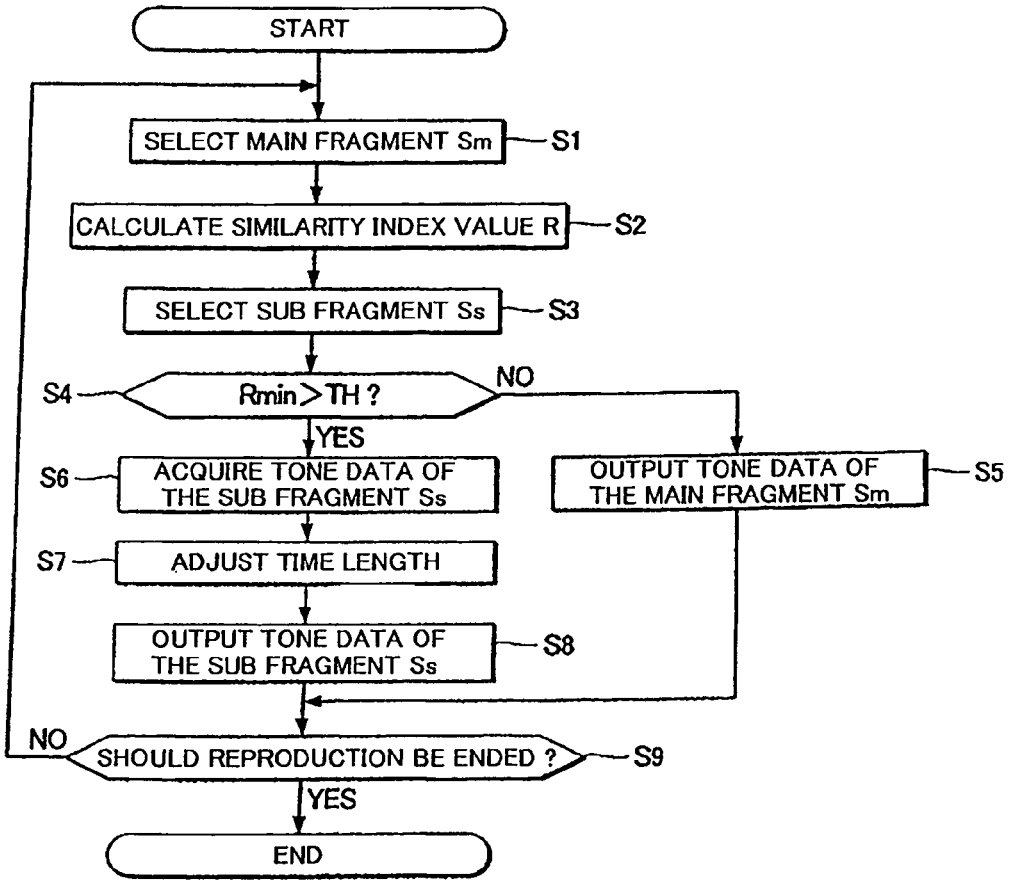
FIG. 5 is a flow chart explanatory of processing performed by a control device in the first embodiment.

FIG. 5 is a flow chart explanatory of specific behavior of the control device 10. Processing of FIG. 5 is executed each time an instruction for starting reproduction of a main music piece is given to the input device 40. Each time any one of the operation members 71 in the area G1 is operated, the coefficient setting section 13 updates the coefficient K of the corresponding object music piece in parallel to the execution of the processing of FIG. 5. Similarly, each time any one of the operation members 73 in the area G2 is operated, the condition setting section 17 updates the corresponding selection condition ($C_A$-$C_D$) in parallel to the execution of the processing of FIG. 5.

Once the processing of FIG. 5 is started, the processing section 18 selects one of the main fragments Sm included in the main music piece, at step S1. Immediately after the start of the processing of FIG. 5, the main fragment Sm located at the leading end of the loop of the main music piece is selected. The similarity index calculation section 11 calculates a similarity index value R between the main fragment Sm selected at step S1 (hereinafter referred to as "selected main fragment Sm") and each individual one of the plurality of sub fragments Ss in accordance with the coefficient K, at step S2. The sub fragments Ss include not only the sub fragments Ss of the object music pieces other than the main music piece, but also the sub fragments Ss other than the selected main fragment Sm of the main music piece.

Then, at step S3, the selection section 16 selects, only within a range where the number of sub fragments Ss to be selected from one object music piece does not exceed the maximum number of selection $C_C$, a predetermined number of sub fragments Ss, corresponding to the total number of selection $C_C$, with one of the sub fragments Ss, which is lower than the reference position $C_A$ in the order of descending similarity index values R by a specific number of positions corresponding to the random number r, designated as the leading-end sub fragment Ss of the selected sub fragments group.

Then, at step S4, the processing section 18 determines whether or not the minimum value Rmin of the similarity index values R of the sub fragments Ss selected by the selection section 16 at step S3 exceeds a threshold value TH. If answered in the negative at step S4 (namely, any sub fragment Ss that is not sufficiently similar to the selected main fragment Sm is included in the sub fragments Ss selected by the selection section 16), then the processing section 18 acquires the tone data A of the selected main fragment Sm from the storage device 20 and outputs the acquired tone data A to the sounding device 30, at step S5. Thus, for the current selected main fragment Sm, a tone of the main music piece is audibly reproduced via the sounding device 30.

On the other hand, if answered in the affirmative at step S4 (namely, all of the sub fragments Ss selected by the selection section 16 are sufficiently similar to the selected main fragment Sm), then the processing section 18 acquires the tone data A of each of the sub fragments Ss selected by the selection section 16, in place of the tone data A of the selected main fragment Sm, at step S6. Further, the processing section 18 processes the tone data acquired at step S6 to be equal in time length to the selected main fragment Sm, at step S7. At step S7, it is possible to make the time length of the tone data A, acquired at step S6, agree with the time length of the tone data A of the selected main fragment Sm while maintaining the original tone pitch, using a conventionally-known technique for adjusting a tempo without changing a tone pitch. Then, the processing section 18 adds together the tone data A of the individual sub fragments Ss, processed at step S7, and outputs the resultant added tone data A to the sounding device 30 at step S8. Thus, for the current selected main fragment Sm, a tone of another music piece similar to the selected main fragment Sm is audibly reproduced via the sounding device 30, instead of the tone of the main music piece.

Following step S5 or S8, the processing section 18 determines, at step S9, whether or not an instruction for ending the reproduction of the music piece has been given to the input device 40. With an affirmative (YES) determination at step S9, the processing section 18 ends the processing of FIG. 5. If, on the other hand, no instruction for ending the reproduction of the music piece has been given to the input device 40 as determined at step S9 (NO determination at step S9), another main fragment Sm of the main music piece immediately following the current selected main fragment Sm is selected at step S1, and then the operations at and after step S2 are carried out. Further, if the selected main fragment Sm immediately before step S1 is the last main fragment Sm of the loop, the first (leading) fragment Sm is selected as a new selected main fragment Sm at step S1. Namely, the loop of the main music piece, partly replaced with one or more other fragments S, is reproduced repetitively.

In the instant embodiment, as set forth above, the main fragments Sm of the main music piece are replaced with sub fragments Ss selected in accordance with the similarity index values R (typically, sub fragments Ss similar in musical character to the main fragments Sm). Thus, even where the user is not sufficiently familiar with similarity and harmonizability among the object music pieces, the instant embodiment permits production of auditorily-natural music piece without substantially impairing the melodic sequence of the main music piece. Further, because each music piece is divided into fragments S on a beat-by-beat basis and sub fragments Ss, selected by the selection section 16, are used for processing of a main fragment Sm after being adjusted to the time length of the main fragment Sm (step S7), the rhythm feeling of the main music piece will not be impaired either.

Further, because the similarity index value R, serving as the index for the sub fragment selection by the selection section 16, is controlled in accordance with the coefficient K, sub fragments Ss of an object music piece, for which the coefficient K is set at a greater value, has a higher chance of being selected by the selection section 16, i.e. higher frequency of selection by the selection section 16. As the coefficient K of the object music piece is increased or decreased through user's operation performed via the input device 40, frequency with which the main fragment Sm is replaced with the sub fragment Ss of the object music piece increase or decrease. Thus, the instant embodiment permits organization of a variety of or diverse music pieces agreeing with user's preferences, as compared to the construction where the coefficients K are fixed (i.e., where the basic index value R0 calculated by the similarity determination section 12 is output to the selection section 16 as is). Further, with the instant embodiment, where the coefficients K of the object music pieces are adjusted by movement of the operation members 71 emulating actual slider operators, there can also be achieved the advantageous benefit that the user can intuitively grasp each object music piece output on a preferential basis.

Further, in the instant embodiment, any of the conditions of the selection by the selection section 16 is variably controlled in accordance with an input to the input device 40. Thus, the instant embodiment permits production of diverse music pieces as compared to the construction where the conditions of the selections are fixed. For example, because the reference position $C_A$ in the similarity order and total number of selection $C_C$ are variably controlled, diverse music pieces can be produced as compared to the construction where only one sub fragment Ss presenting the greatest similarity index value R is fixedly selected. Further, because the random number r defined by the random number range $C_B$ is employed as a reference for the sub fragment selection, the sub fragment Ss selected by the selection section 16 is changed as necessary even where the same main music piece is kept selected. Further, if there is defined no limit to the maximum number of selection $C_D$, then there would be a possibility of a reproduced music piece undesirably getting monotonous because only sub fragments Ss of a given object music piece are selected concentratedly. However, with the instant embodiment, where the maximum number of selection $C_D$ from one music piece is clearly defined, it is possible to produce diverse music piece comprising combinations of sub fragments Ss of a multiplicity of object music pieces, by setting the maximum number of selection $C_D$ at a small value. Needless to say, if the maximum number of selection $C_D$ is set at a great value, then it is possible to select sub fragments Ss concentratedly from a specific object music piece that is similar to a main music piece.

B. Second Embodiment

Next, a description will be given about a second embodiment of the present invention. Elements similar in function and construction to those in the first embodiment are indicated by the same reference numerals and characters as in the first embodiment and will not be described here to avoid unnecessary duplication.

Figure 6:
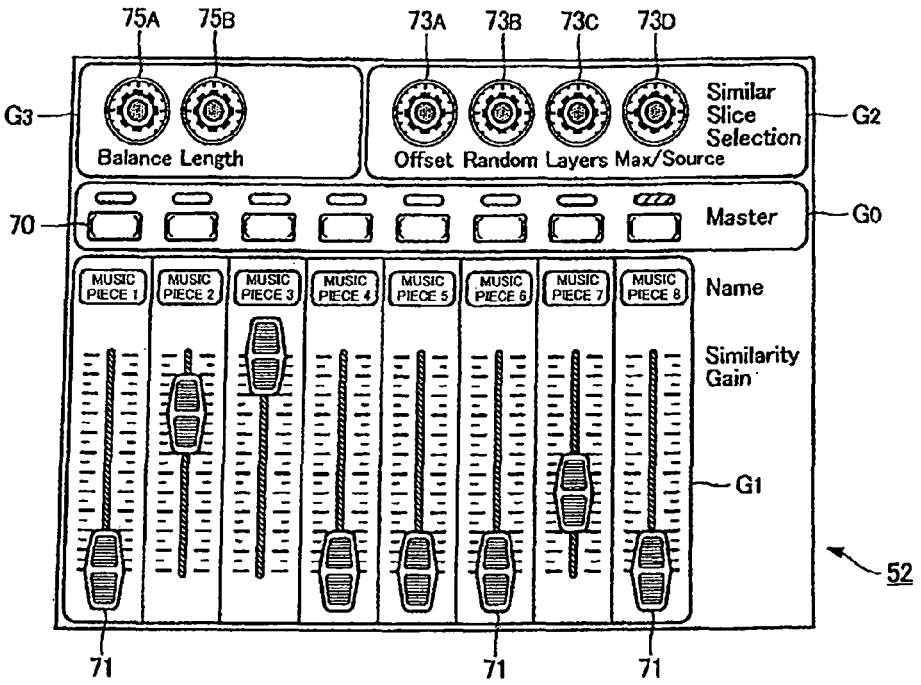
FIG. 6 is a diagram schematically showing an example of an operation screen employed in a second embodiment.

FIG. 6 is a diagram schematically showing an example of an operation screen 52 employed in a music piece processing apparatus according to a second embodiment of the present invention. The operation screen 52 employed in the second embodiment includes an area G3 in addition to the areas G0-G2. The area G3 includes images of a plurality of operation members 75 (75A and 75B), and the user can rotate any desired one of the operation members 75 by operating the input device 40.

Figure 7:
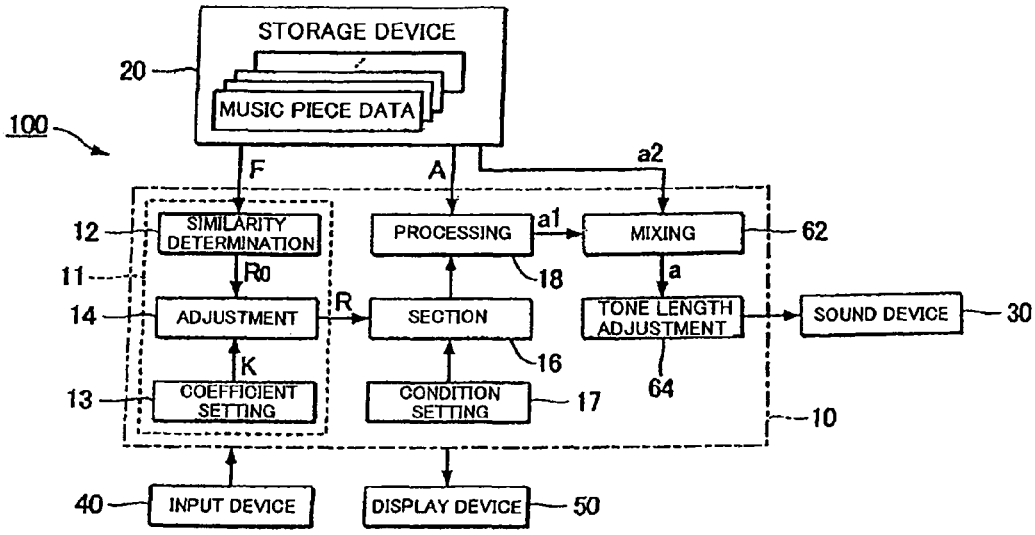
FIG. 7 is a block diagram showing an example general setup of a music piece processing apparatus in accordance with a second embodiment of the present invention.
Figure 8:
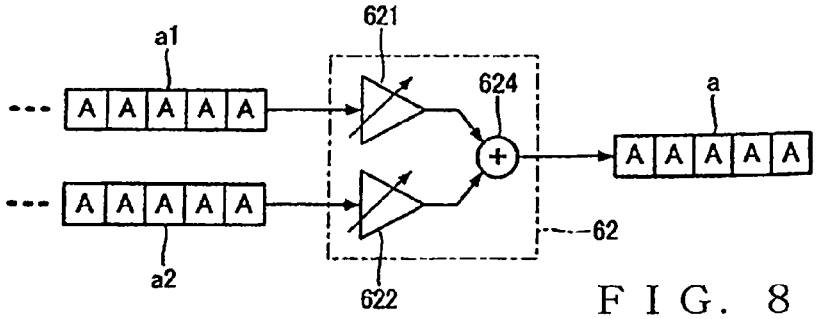
FIG. 8 is a block diagram showing a detailed construction of a mixing section.

FIG. 7 is a block diagram showing an example general setup of the music piece processing apparatus in accordance with the second embodiment of the present invention, which is different from the first embodiment in that it includes a mixing section 62 and tone length adjustment section 64 additionally provided at a stage following the processing section 18. The mixing section 62 mixes together a data train a1 of tone data A having been processed by the processing section 18 and a data train a2 of tone data A of a main music piece sequentially output from the storage device 20, to thereby generate a data train a of the mixed tone data A. More specifically, the mixing section 62, as shown in FIG. 8, includes a multiplier 621 for multiplying each tone data A of the data train al by a coefficient g ($0 \leqq g \leqq 1$), a multiplier 622 for multiplying each tone data A of the data train a2 by a coefficient g (1·g), and an adder 624 for adding together the respective outputs of the two multipliers 621 and 622. Further, the mixing section 62 variably controls the coefficient g (mixing ratio between the data train a1 and the data train a2) in accordance with an operating angle of the operation member 75A operated by the user.

Figure 9:
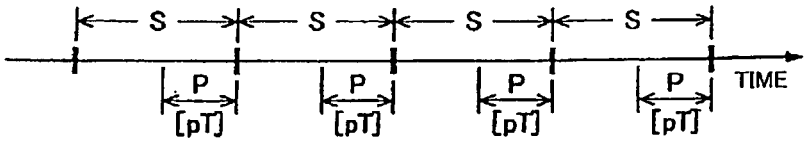
FIG. 9 is a conceptual diagram explanatory of processing performed by a tone length adjustment section.

FIG. 9 is a conceptual diagram showing sections (fragments S) of a tone, indicated by the individual tone data A of the data train a having been mixed by the mixing section 62, arranged on the time axis. The tone length adjustment section 64 processes each of the tone data A of the data train a so that a portion P (time length pT) from a halfway point to an end point of a tone generating section of the tone, indicated by each of the tone data A having been mixed by the mixing section 62, is made a silent portion. The tone length adjustment section 64 variably controls the time length pT in accordance with an operating angle of the operation member 75B having been operated by the user. Because a time length over which the tone is actually sounded decreases as the time length pT increases, a tone imparted with an effect, such as staccato, can be sounded via the sounding device 30.

Because the mixing ratio between the data train a1 and the data train a2 (i.e., coefficient g) and the time length of the silent portion is variably controlled, the second embodiment can reproduce a music piece in a diverse manner as compared to the above-described first embodiment. For example, if the coefficient g is increased through user's operation of the operation member 75A, a tone having been processed by the processing section 18 is reproduced predominantly. Further, as the time length pT is increased through user's operation of the operation member 75B, a tone can be reproduced with an increased rhythm feeling (e.g., staccato feeling).

Whereas the tone length adjustment section 64 is provided at a stage following the mixing section 62 in the illustrated example of FIG. 7, the tone length adjustment section 64 may be provided at a stage preceding the mixing section 62. For example, the tone length adjustment section 64 adjusts, for at least one of the data train a1 processed by the processing section 18 and data train a2 output from the storage device 20, the time length pT of the fragment S, indicated by the tone data A, in accordance with an operating angle of the operation member 75B, and then it outputs the adjusted result to the mixing section 62. Namely, it is only necessary that each of the mixing section 62 and tone length adjustment section 64 be constructed to process the tone data A having been processed by the processing section 18. Further, either one of the mixing section 62 and tone length adjustment section 64 may be dispensed with.

C. Third Embodiment

Figure 10:
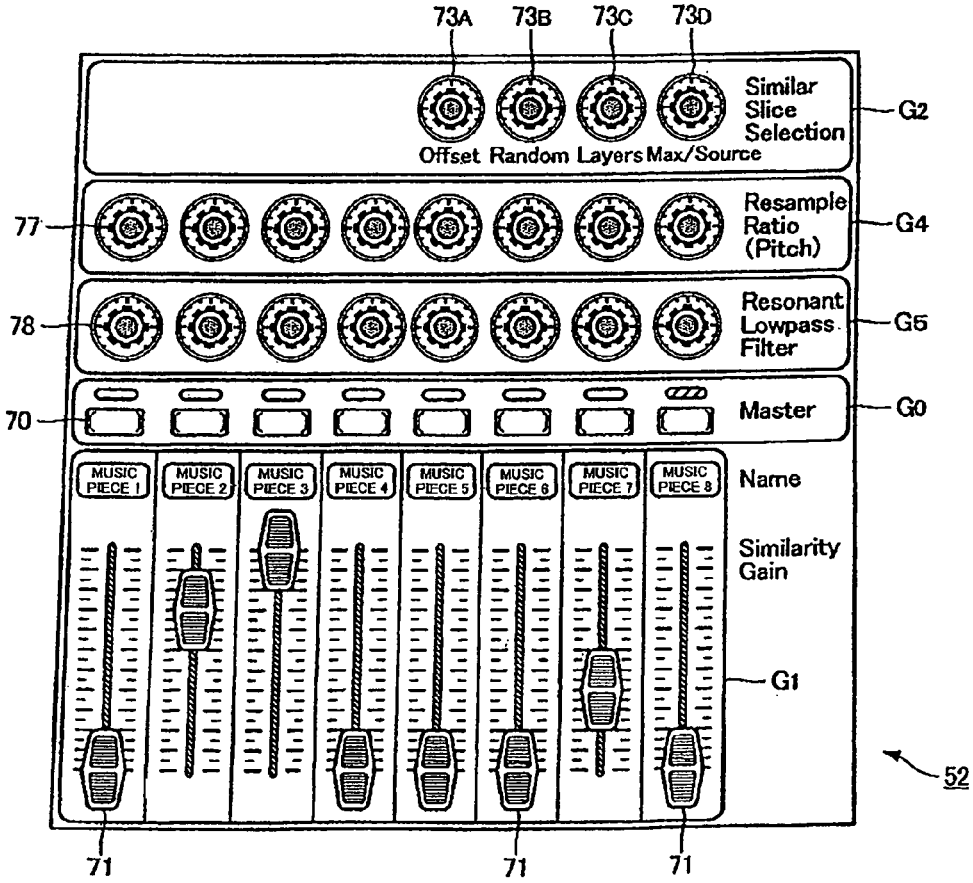
FIG. 10 is a diagram schematically showing example details of an operation screen employed in a third embodiment.

FIG. 10 is a diagram schematically showing an example of an operation screen 52 employed in a music piece processing apparatus according to a third embodiment of the present invention. The operation screen 52 employed in the third embodiment includes areas G4 and G5 in addition to the areas G0-G2. The area G4 includes images of a plurality of operation members 77 corresponding to object music pieces. Similarly, the area G5 includes images of M operation members 78 corresponding to the object music pieces. The user can rotate any desired one of the operation members 77 and 78 by operating the input device 40.

Figure 11:
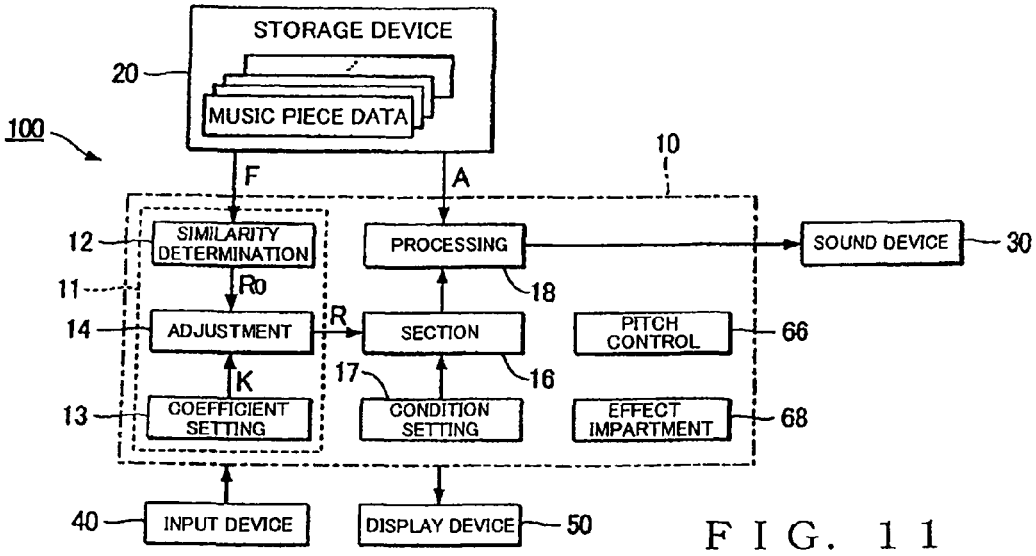
FIG. 11 is a block diagram showing an example general setup of a music piece processing apparatus in accordance with a third embodiment of the present invention.

FIG. 11 is a block diagram showing an example general setup of the music piece processing apparatus in accordance with the third embodiment of the present invention, which is different from the first embodiment in that a pitch control section 66 and effect impartment section 68 are added to the control device 10. The pitch control section 66 variably controls the tone pitch of the tone data A of each of the sub fragments Ss, selected by the selection section 16 from one object music piece, in accordance with an operating angle of one of the operators 77 which is provided in the area G4 and corresponds to the object music piece. Namely, the pitch of the tone of each of the sub fragments Ss is controlled individually for each of the object music pieces. Any desired one of the conventionally-known techniques may be employed for the pitch control. For example, there may be advantageously employed the technique which changes the tone pitch and tone length by re-sampling of the tone data A, or the technique which changes only the tone pitch by expansion of the tone data A.

The effect impartment section 68 imparts an acoustic effect to the tone data A of each of the sub fragments Ss selected by the selection section 16. The acoustic effect to be imparted to the tone data A of each of the sub fragments Ss selected from one object music piece is variably controlled in accordance with an operating angle of any one of the operation members 78 which is provided in the area G4 and corresponds to the object music piece. The effect impartment section 68 in the instant embodiment is, for example, in the form of a low-pass filter (resonance low-pass filter) that imparts a resonance effect to the tone data A, and it controls the resonance effect to be imparted the tone data A by changing a cutoff frequency in accordance with an operating angle of the operation member 78.

The above-described third embodiment, where the tone pitch and acoustic effect of tone data A are individually controlled per object music piece in response to inputs to the input device 40, can flexibly produce a music piece agreeing with user's intension. For example, the third embodiment can organize a music piece which has a feeling of unity in its melodic sequence, by the user appropriately operating the operation members 77 and 78 so as to achieve approximation in pitch and acoustic characteristic among the tone data A of the plurality of object music pieces. Note that the type of the acoustic effect to be imparted by the effect impartment section 68 and the type of the characteristic to be controlled may be varied as desired. For example, the effect impartment section 68 may impart the tone data A with a reverberation effect of which a reverberation time has been set in accordance with an operating angle of the operation member 78.

D. Modifications

The above-described embodiments may be modified variously as exemplified below. Note that two or more of the following modifications may be used in combination.

(1) Modification 1

Whereas each of the first to third embodiments has been described above as constructed to perform the processing on the entire loop of the main music piece, the object section to be processed (defined by, for example, by the number of measures or beats) may be variably controlled in accordance with an input to the input device 40. When the processing of FIG. 5 performed on the last main fragment Sm of a user-designated section of a main music piece has been completed, the control device 10, at step S1 immediately following the completion of the processing on the last main fragment Sm, selects the leading-end main fragment Sm of that section as a new selected main fragment Sm. There may be advantageously employed a construction for stopping or resuming the reproduction of the music piece in response to user's operation of the input device 40, and/or a construction for changing a reproducing point over to the beginning of the music piece (i.e., starting the reproduction at the beginning of the music piece) in response to user's operation of the input device 40.

(2) Modification 2

Each of the first to third embodiments has been described above in relation to the case where the user individually designates any one of the M object music pieces. Alternatively, respective attribute information (such as musical genres and times) of a plurality of music pieces may be prestored in the storage device 20 so that two or more of the music pieces corresponding to user-designated attribute information are automatically selected as object music pieces. Further, it is also advantageous to employ a construction where various settings at the time of reproduction of a music piece (such settings will hereinafter be referred to as "reproduction information") are stored by the control device 10 into the storage device 20 or other storage device in response to user's operation of the input device 40. The reproduction information may include, for example, not only information designating a main music piece and M object music pieces but also variables set via the operation screen 52, such as selection conditions $C_A$-$C_D$, coefficients K corresponding to the object music pieces, coefficient g, time length pT and pitches and acoustic effects of the object music pieces. In response to user's operation performed via the input device 40, the control device 40 sets the above-mentioned variables to contents designated by the reproduction information. With such arrangements, it is possible to reproduce a melodic sequence of a previously produce music piece.

(3) Modification 3

Whereas each of the first to third embodiments has been described above as using four types of variables ($C_a$-$C_D$) defining the selection conditions, only one of the variables ($C_a$-$C_D$) may be used as the selection condition. In a case where only the reference position $C_A$ is used as the selection condition, for example, one sub fragment located in the reference position $C_A$ in the order of decreasing similarity with the main fragment Sm (i.e., similarity order) is selected. Further, in a case where only the random number range $C_B$ is selected as the selection condition, one sub fragment Ss lower than the sub fragment Ss located at the highest position in the similarity order by a specific number of positions corresponding to the random number r is employed as the selection condition. In each of these cases, either one or a plurality of sub fragments Ss may be selected by the selection section 16. Further, in a case where only the total number of selection $C_C$ is selected as the selection condition, a given number of sub fragment Ss corresponding to the total number of selection $C_C$, as counted from the sub fragment Ss located at the highest position in the similarity order are selected. Further, it is also advantageous to variably control, as the selection condition, the threshold value TH to be used at step S4 of FIG. 5. Note that, in the second and third embodiment, the selection condition may alternatively be fixed (namely, the condition setting section 17 may be omitted). For example, the selection section 16 uniformly selects one sub fragment Ss presenting the greatest similarity index value R.

(4) Modification 4

Figure 12:
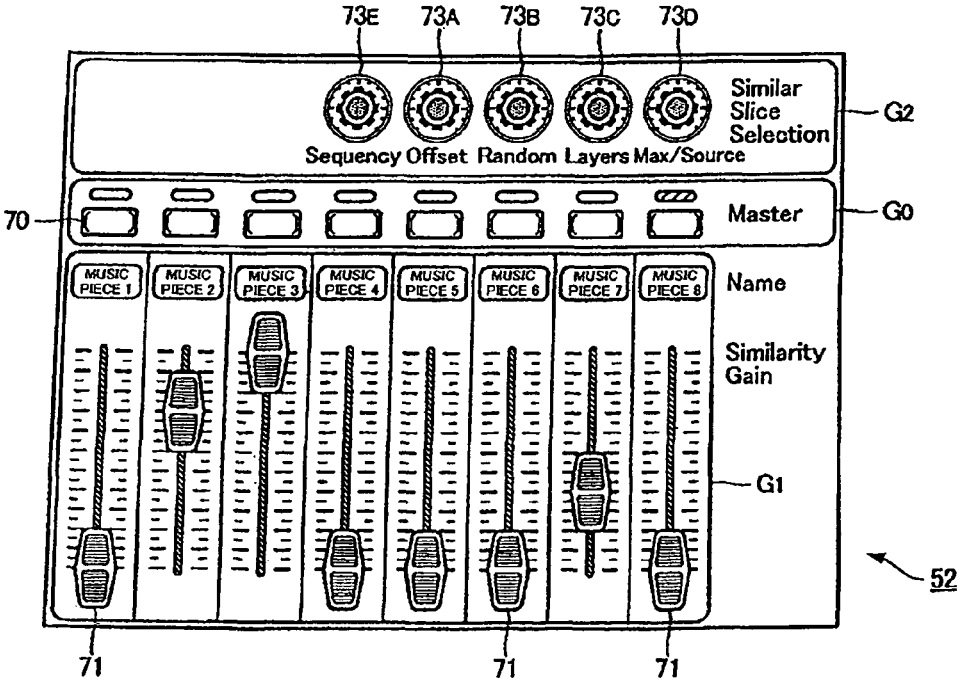
FIG. 12 is a diagram schematically showing an example operation screen employed in this modification.

There may also be employed a construction for enhancing a possibility or chance of the selection section 16 selecting one of a plurality of sub fragment Ss which follows a sub fragment Ss selected for the last main fragment Sm in a music piece, i.e. a possibility of sub fragment Ss of the same music piece being selected in succession. FIG. 12 is a diagram schematically showing an operation screen 52 employed in this modification. As shown, the operation screen 52 employed in this modification includes an operation member 73E (Sequency) added to the area G2 of FIG. 3, and this operation member 73E is rotatable by the user operating the input device 40. The adjustment section 14 in the similarity index calculation section 11 variably controls a degree of sequency SQ in accordance with an operating angle of the operation member 73E.

Once the similarity determination section 12 calculates a basic index value R0 between one main fragment Sm and each individual one of the sub fragments Ss, the adjustment section 14 calculates a similarity index value R by adjusting the basic index value R0 in accordance with the coefficient K, in generally the same manner as in the first embodiment. In this case, however, the adjustment section 14 adds an adjustment, corresponding to the coefficient K, to the basic index value R0 of the sub fragment that follows the sub fragment Ss (i.e., "following sub fragment") selected for the last main fragment Sm in the same object music piece, to enhance the degree of similarity in accordance with the degree of sequency SQ and thereby calculate a similarity index value R. For example, the adjustment section 14 calculates, as the similarity index value R, a sum between the basic index value R0 of the following sub fragment Ss adjusted in accordance with the coefficient K and a value corresponding to the degree of sequency SQ. Thus, at step S3 of FIG. 5, a possibility of the following sub fragment Ss being selected is increased. Namely, a possibility of a plurality of sub fragments Ss of the same object music piece being selected in succession in the arranged order is enhanced.

When the degree of sequency SQ is set at a minimum value (e.g., zero), the adjustment section 14 adjusts all of the basic index values R0 on the basis of only the coefficient K. Thus, the object of the selection at step S3 of FIG. 5 is the same as in the first embodiment. When, on the other hand, the degree of sequency SQ is set at a maximum value, the adjustment section 14 calculates a similarity index value R of the following sub fragment Ss such that the following sub fragment Ss is necessarily selected at step S3 of FIG. 5. Thus, if the total number of selection $C_C$ is 1, the sub fragments Ss of the same music piece are sequentially reproduced in the order they are arranged in the music piece.

(5) Modification 5

In each of the above-described embodiments, the selection section is arranged to select a given number of sub fragment Ss corresponding to the total number of selection $C_C$ with the sub fragment Ss, which is lower in the similarity order than the reference position $C_A$ by positions corresponding to the random number r, designated as the leading-end sub fragment of the selected sub fragment group. However, the scheme for selecting the sub fragments Ss corresponding to the random number r may be modified as necessary. For example, random numbers may be generated a plurality of times so that sub fragments Ss lower in position than the reference position $C_A$ by positions corresponding to the individual random numbers r are selected in a non-overlapping manner up to the total number of selection $C_C$.

(6) Modification 6

Each of the above-described embodiments has been described above as outputting the tone data A of the selected main fragment Sm to the sounding device 30 when the minimum value Rmin of the similarity index values R of the individual sub fragments Ss is smaller than the threshold value TH (steps S4 and S5 of FIG. 5). There may also be employed an alternative construction where the similarity index value R of each of the sub fragments Ss is compared against the threshold value TH and only those sub fragments Ss whose similarity index values R are greater than the threshold value TH are used for processing of the main music piece.

(7) Modification 7

In each of the above-described embodiments, the other fragments S than the main fragment Sm of the main music piece are made sub fragments Ss as candidates for selection by the selection section 16. However, it is also advantageous to employ a modified construction where only individual sub fragments S of (M−1) object music pieces, excluding the main music piece, are made sub fragments Ss. Because the individual fragments S in the same music piece are often similar to one another in acoustic feature, it is highly possible that, in the above-described first embodiment, the fragments S of the main music piece will be selected as sub fragments Ss similar to the main fragment Sm. With the construction where the fragments S of the main music piece are excluded from the candidates for selection by the selection section 16, on the other hand, it is possible to produce diverse music pieces using the fragments S of the other object music pieces than the main music piece.

(8) Modification 8

Whereas each of the first to third embodiments has been described above as replacing the tone data of the main fragment Sm with the tone data of a sub fragment Ss, the scheme for processing the main fragment Sm on the basis of the sub fragment Ss is not necessarily limited to such replacement of the tone data A. For example, the tone data A of the main fragment Sm and the tone data A of a predetermined number of sub fragments Ss may be mixed at a predetermined mixing ratio so that the mixed results are output. However, with the construction where the main fragment Sm is merely replaced with a sub fragment Ss as described above in relation to the first to third embodiments, there can be achieved the benefit that processing loads on the control device 10 can be significantly reduced.

(9) Modification 9

The scheme for calculating a similarity index value R on the basis of respective character values F of a main fragment Sm and sub fragment Ss may be modified as desired. For example, whereas each of the first to third embodiments has been described above in relation to the case where the similarity index value R increases as the degree of similarity between the main fragment Sm and sub fragment Ss increases, the similarity index value R may be a numerical value (e.g., distance between the character values F) that decreases as the degree of similarity between the main fragment Sm and sub fragment Ss increases.

(10) Modification 10

Furthermore, each of the first to third embodiments has been described above in relation to the case where the operation screen 52 operable by the user to manipulate the music piece processing apparatus 100 is displayed as a screen image on the display device 50. Alternatively, input equipment having actual hardware operation members, corresponding the various operation members illustratively shown as images in FIGS. 6 and 10, may be used for operation by the user.

This application is based on, and claims priority to, JP PA 2007-186,149 filed on 17 Jul. 2007. The disclosure of the priority applications, in its entirety, including the drawings, claims, and the specification thereof, is incorporated herein by reference.

What is claimed is:

1. A music piece processing apparatus comprising:

a storage section that stores music piece data sets of a plurality of music pieces, each of the music piece data sets comprising respective tone data of a plurality of fragments of the music piece and respective character values of the fragments, the character value of each of the fragments being indicative of a musical character of the fragment;

a similarity index calculation section that selects, as main fragments, a plurality of fragments of a main music piece selected from among the plurality of music pieces stored in said storage section; specifies, in association with each of the selected main fragments, as sub fragments, a plurality of fragments, other than the associated main fragment, of two or more music pieces selected from among said plurality of music pieces stored in said storage section; and calculates, in association with each of the selected main fragments, similarity index values indicative of degrees of similarity between the character value of the associated main fragment and character values of the specified sub fragments;

a condition setting section that variably sets a selection condition;

a selection section that selects, for each of the main fragments of the main music piece and from among the sub fragments specified in association with the main fragments, a sub fragment presenting a similarity index value that satisfies the selection condition, wherein the sub fragment can change in response to a change in the selection condition variably set by said condition setting section; and a processing section that processes the tone data of each of the main fragments of the main music piece to replace the tone data of each of the main fragments with the tone data of the sub fragment selected by said selection section for the main fragment to thereby produce a new music piece based on the processed main music piece.

2. The music piece processing apparatus as claimed in claim 1 wherein said condition setting section sets the selection condition on the basis of user's input operation performed via an input device.

3. The music piece processing apparatus as claimed in claim 1 wherein said condition setting section sets a plurality of the selection conditions, at least one of the plurality of the selection conditions being settable on the basis of user's input operation, and said selection section selects the sub fragment in accordance with a combination of the plurality of the selection conditions.

4. The music piece processing apparatus as claimed in claim 1 wherein said condition setting section sets a reference position, in order of the similarity with the main fragment, as the selection condition on the basis of user's input operation, and said selection section selects a sub fragment located at a position corresponding to the reference position in the order of similarity with the main fragment.

5. The music piece processing apparatus as claimed in claim 1 wherein said condition setting section sets a random number range as the selection condition, and said selection section generates a random number within the random number range and selects a sub fragment located at a position corresponding to the random number in the order of similarity with the main fragment.

6. The music piece processing apparatus as claimed in claim 1 wherein said condition setting section sets a total number of selection as the selection condition, and said selection section selects a given number of the sub fragments corresponding to the total number of selection.

7. The music piece processing apparatus as claimed in claim 1 wherein said condition setting section sets a maximum number of selection as the selection condition, and said selection section selects, for each of the main fragments, a plurality of the sub fragments while limiting a maximum number of the sub fragments, selectable from one music piece, to the maximum number of selection.

8. The music piece processing apparatus as claimed in claim 1 which further comprises a mixing section that mixes together the tone data having been processed by said processing section and original tone data of the main music piece and outputs the mixed tone data.

9. The music piece processing apparatus as claimed in claim 8 wherein a mixing ratio between the tone data having been processed by said processing section and the original tone data of the main music piece is set on the basis of user's input operation performed via an input device.

10. The music piece processing apparatus as claimed in claim 1 which further comprises a tone length adjustment section that processes each of the tone data, having been processed by said processing section, so that a predetermined portion of the tone data is made a silent portion.

11. The music piece processing apparatus as claimed in claim 10 wherein said predetermined portion is a portion from a halfway time point to an end point of a tone generating section corresponding to the tone data, and a length of the predetermined portion is set on the basis of user's operation performed via an input device.

12. The music piece processing apparatus as claimed in claim 1 which further comprises a pitch control section that controls, for each of the two or more music pieces, a pitch of a tone, represented by the tone data of each of the sub fragments selected by said selection section, on the basis of user's operation performed via an input device.

13. The music piece processing apparatus as claimed in claim 1 which further comprises an effect impartment section that imparts an acoustic effect to the tone data of each of the sub fragments selected by said selection section, and wherein, for each of the two or more music pieces, said effect impartment section controls the acoustic effect to be imparted, on the basis of user's operation performed via an input device.

14. The music piece processing apparatus as claimed in claim 1 wherein said similarity index calculation section includes:

a similarity determination section that calculates, for each of the main fragments, a basic index value indicative of similarity or dissimilarity in character value between the main fragment and each of the sub fragments; and an adjustment section that determines a similarity index value on the basis of the basic index value calculated by said similarity determination section, wherein, of the basic index values calculated for individual ones of the sub fragments with respect to a given main fragment, said adjustment section adjusts the basic index values of one or more sub fragments, following one or more sub fragments selected by said selection section for the given main fragment, so as to increase a degree of similarity, to thereby determine the similarity index value.

15. The music piece processing apparatus as claimed in claim 1 wherein said similarity index calculation section includes:

a similarity determination section that calculates, for each of the main fragments, a basic index value indicative of similarity or dissimilarity in character value between the main fragment and each of the sub fragments;

a coefficient setting section that sets a coefficient separately for each of the music pieces on the basis of user's input operation performed via an input device; and an adjustment section that calculates the similarity index value by adjusting each of the basic index values, calculated by said similarity determination section, in accordance with the coefficient set by said coefficient setting section.

16. The music piece processing apparatus as claimed in claim 1 wherein each of the fragments is a section obtained by dividing the music piece at time points synchronous with beats.

17. The music piece processing apparatus as claimed in claim 1 wherein the two or more music pieces selected from among said plurality of music pieces stored in said storage section include the main music piece.

18. The music piece processing apparatus as claimed in claim 1 wherein the two or more music pieces selected from among said plurality of music pieces stored in said storage section do not include the main music piece.

19. A computer-implemented music piece processing method, said music piece processing method using a storage section that stores music piece data sets of a plurality of music pieces, each of the music piece data sets comprising respective tone data of a plurality of fragments of the music piece and respective character values of the fragments, the character value of each of the fragments being indicative of a musical character of the fragment, said music piece processing method comprising:

a calculation step of selecting, as main fragments, a plurality of fragments of a main music piece selected from among the plurality of music pieces stored in the storage section; specifying, in association with each of the selected main fragments, as sub fragments, a plurality of fragments, other than the associated main fragment, of two or more music pieces selected from among said plurality of music pieces stored in the storage section; and calculating, in association with each of the selected main fragments, similarity index values indicative of degrees of similarity between the character value of the associated main fragment and character values of the specified sub fragments;

a step of variably setting a selection condition;

a selection step of selecting, for each of the main fragments of the main music piece and from among the sub fragments specified in association with the main fragments, a sub fragment presenting a similarity index value that satisfies the selection condition, wherein the sub fragment can change in response to a change in the selection condition variably set by said condition setting section; and a step of processing the tone data of each of the main fragments of the main music piece to replace the tone data of each of the main fragments with the tone data of the sub fragment selected by said selection step for the main fragment to thereby produce a new music piece based on the processed main music piece.

20. A computer-readable storage medium containing a group of instructions for causing a computer to perform a music piece processing procedure, said music piece processing procedure using a storage section that stores music piece data sets of a plurality of music pieces, each of the music piece data sets comprising respective tone data of a plurality of fragments of the music piece and respective character values of the fragments, the character value of each of the fragments being indicative of a musical character of the fragment, said music piece processing procedure comprising:

a calculation step of selecting, as main fragments, a plurality of fragments of a main music piece selected from among the plurality of music pieces stored in the storage section; specifying, in association with each of the selected main fragments, as sub fragments, a plurality of fragments, other than the associated main fragment, of two or more music pieces selected from among said plurality of music pieces stored in the storage section; and calculating, in association with each of the selected main fragments, a similarity index values indicative of degrees of similarity between the character value of the associated main fragment and character values of the specified sub fragments;

a step of variably setting a selection condition;

a selection step of selecting, for each of the main fragments of the main music piece and from among the sub fragments specified in association with the main fragments, a sub fragment presenting a similarity index value that satisfies the selection condition, wherein the sub fragment can change in response to a change in the selection condition variably set by said condition setting section; and a step of processing the tone data of each of the main fragments of the main music piece to replace the tone data of each of the main fragments with the tone data of the sub fragment selected by said selection step for the main fragment to thereby produce a new music piece based on the processed main music piece.

* * * * *